US008015918B2

(12) United States Patent
Saito et al.

(10) Patent No.: US 8,015,918 B2
(45) Date of Patent: Sep. 13, 2011

(54) CLEANING APPARATUS

(75) Inventors: Hirofumi Saito, Ibaraki (JP); Yoshihito Nakamura, Ibaraki (JP); Akihiro Matsukawa, Ibaraki (JP); Katsuhisa Nakamura, Ibaraki (JP); Masaaki Asami, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 12/077,158

(22) Filed: Mar. 17, 2008

(65) Prior Publication Data

US 2008/0229952 A1 Sep. 25, 2008

(30) Foreign Application Priority Data

Mar. 20, 2007 (JP) ..... 2007-072148

(51) Int. Cl.
*B41F 35/00* (2006.01)

(52) U.S. Cl. ..... 101/425; 101/424

(58) Field of Classification Search ..... 101/424, 101/425

See application file for complete search history.

(56) References Cited

U.S. PATENT DOCUMENTS

| | | | | |
|---|---|---|---|---|
| 4,270,450 | A * | 6/1981 | Difflipp et al. | 101/142 |
| 4,311,095 | A * | 1/1982 | Jeschke | 101/425 |
| 4,747,348 | A * | 5/1988 | Jeschke et al. | 101/425 |
| 5,174,209 | A * | 12/1992 | Rodi et al. | 101/424 |
| 5,259,313 | A * | 11/1993 | Gibson et al. | 101/425 |
| 5,463,951 | A * | 11/1995 | Waizmann et al. | 101/423 |
| 6,070,530 | A * | 6/2000 | Lippold et al. | 101/424 |
| 6,588,337 | B1 * | 7/2003 | Kreckel et al. | 101/424 |
| 6,901,859 | B2 * | 6/2005 | Yokoyama | 101/425 |
| 7,517,045 | B2 * | 4/2009 | Inoue | 347/23 |
| 2004/0163561 | A1 * | 8/2004 | Yokoyama | 101/425 |
| 2005/0061182 | A1 * | 3/2005 | Ebina et al. | 101/425 |
| 2006/0137553 | A1 * | 6/2006 | Corti et al. | 101/425 |

FOREIGN PATENT DOCUMENTS

| | | | |
|---|---|---|---|
| CN | 1524693 | A | 9/2004 |
| JP | 2000-289190 | A | 10/2000 |

* cited by examiner

*Primary Examiner* — Anthony H. Nguyen
(74) *Attorney, Agent, or Firm* — Blakely, Sokoloff, Taylor & Zafman

(57) ABSTRACT

A cleaning apparatus includes a first liquid supply unit, second cylinder, cleaning unit, third cylinder, second liquid supply unit, first cleaning liquid supply unit, and controller. The first liquid supply unit supplies a transfer liquid to a first cylinder. The second cylinder performs transfer to one surface of a transfer target body with the transfer liquid transferred from the first cylinder. The cleaning unit cleans the circumferential surface of the second cylinder in contact with it. The third cylinder is arranged to oppose the second cylinder and performs transfer to the other surface of the transfer target body. The second liquid supply unit supplies the transfer liquid to the third cylinder. The first cleaning liquid supply unit supplies a cleaning liquid to at least one of the first cylinder and the third cylinder. The controller controls the control unit to clean the second cylinder while the second cylinder is in contact with the first cylinder and the third cylinder.

10 Claims, 13 Drawing Sheets

CLEANING APPARATUS

BACKGROUND OF THE INVENTION

The present invention relates to a cleaning apparatus which cleans a cylinder in a transfer device (coating device/printing device) which performs transfer (coating/printing) on a transfer target body (sheet/web).

A conventional printing apparatus comprises a printing unit which prints a sheet fed from a feeder, a coater cylinder which coats the sheet printed by the printing unit, and a varnish roller which transfers varnish onto the coater cylinder. In a conventional cleaning apparatus in the printing apparatus having the above arrangement, as disclosed in Japanese Patent Laid-Open No. 2000-289190, immediately before a sheet that precedes the final sheet to be fed from the printing unit by a predetermined number is fed to the coater cylinder, the varnish roller is thrown off from the coater cylinder. After that, the coater cylinder is thrown on (brought into contact with) an impression cylinder and a predetermined number of sheets are fed, so the varnish attached to the circumferential surface of the coater cylinder is transferred to the sheet, thus cleaning the circumferential surface of the coater cylinder.

The conventional cleaning apparatus described above performs so-called "cleaning by printing" in which the varnish attached to the circumferential surface of the coater cylinder is transferred to the sheet, thus cleaning the coater cylinder. This accompanies wasted paper and increases the cost particularly when the sheet is expensive. It also requires the operation of removing the cleaning waste paper stacked on the delivery pile, increasing the load to the operator.

SUMMARY OF THE INVENTION

It is an object of the present invention to provide a cleaning apparatus in which waste paper is eliminated to reduce the cost.

It is another object of the present invention to provide a cleaning apparatus in which the load to the operator is decreased.

In order to achieve the above objects, according to the present invention, there is provided a cleaning apparatus comprising first liquid supply means for supplying a transfer liquid to a first cylinder, a second cylinder which performs transfer to one surface of a transfer target body with the transfer liquid transferred from the first cylinder, a cleaning unit which cleans a circumferential surface of the second cylinder in contact therewith, a third cylinder which is arranged to oppose the second cylinder and performs transfer to the other surface of the transfer target body, second liquid supply means for supplying the transfer liquid to the third cylinder, first cleaning liquid supply means for supplying a cleaning liquid to at least one of the first cylinder and the third cylinder, and control means for controlling the cleaning unit to clean the second cylinder while the second cylinder is in contact with the first cylinder and the third cylinder.

DESCRIPTION OF THE PREFERRED EMBODIMENT

A printing press according to an embodiment of the present invention will be described in detail with reference to FIGS. 1 to 14.

[Sheet-Fed Rotary Printing Press]

Figure 1:
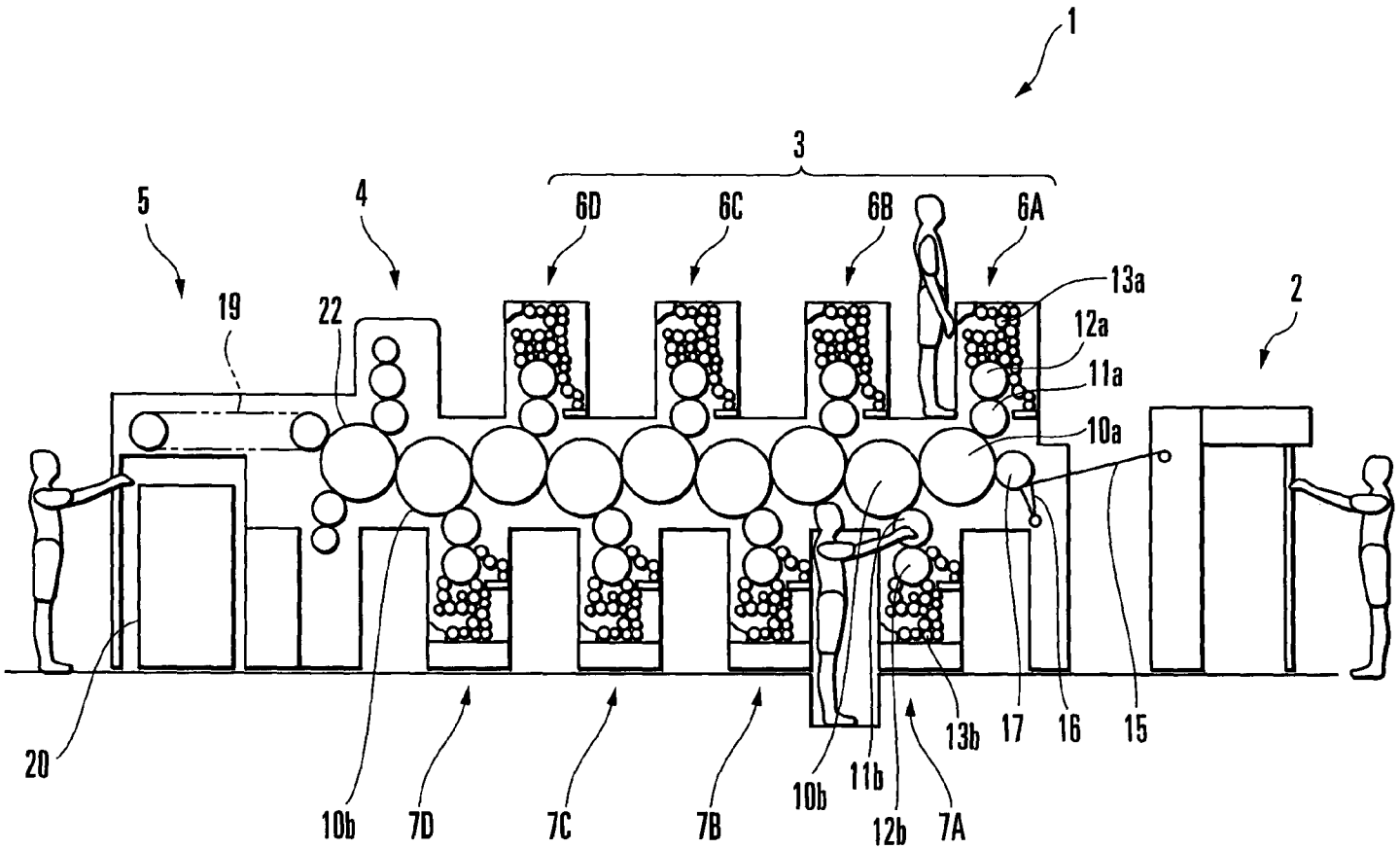
FIG. 1 is a side view showing a sheet-fed rotary printing press as a whole.

As shown in FIG. 1, a sheet-fed rotary printing press 1 comprises a feeder 2 which feeds a sheet (transfer target body), a printing unit 3 which prints the sheet fed from the feeder 2, a coating unit 4 which coats (by transfer) the obverse and reverse of the sheet printed by the printing unit 3 with varnish (transfer liquid), and a delivery unit 5 to which the sheet coated by the coating unit 4 is delivered. The printing unit 3 comprises first to fourth obverse printing units 6A to 6D and first to fourth reverse printing units 7A to 7D. The sheet-fed rotary printing press 1 serves as a liquid transfer machine. The feeder 2 serves as a supply unit. The printing unit 3 and coating unit 4 serve as a liquid transfer unit. The delivery unit 5 serves as a discharge unit.

Each of the four obverse printing units 6A to 6D comprises an impression cylinder 10*a* having a gripper unit in its circumferential surface to grip a sheet, a blanket cylinder 11*a* opposing the upper portion of the impression cylinder 10*a*, a plate cylinder 12*a* opposing the upper portion of the blanket cylinder 11*a*, and an ink supply unit 13*a* which supplies ink (transfer target liquid) to the plate cylinder 12*a*. The impression cylinder 10*a* comprises a double-diameter cylinder having a diameter twice that of the plate cylinder 12*a*. The gripper unit serves as a holding unit. The impression cylinder 10*a* serves as a transport cylinder. The blanket cylinder 11*a* serves as a printing cylinder.

Each of the four reverse printing units 7A to 7D comprises an impression cylinder 10*b* having a gripper unit in its circumferential surface to grip a sheet, a blanket cylinder 11*b* opposing the lower portion of the impression cylinder 10*b*, a plate cylinder 12*b* opposing the lower portion of the blanket cylinder 11*b*, and an ink supply unit 13*b* which supplies the ink to the plate cylinder 12*b*. The impression cylinder 10*b* comprises a double-diameter cylinder having a diameter twice that of the plate cylinder 12*b*. The gripper unit serves as a holding unit. The impression cylinder 10*b* serves as a transport cylinder. The blanket cylinder 11*b* serves as a printing cylinder.

In this arrangement, the leading edge of a sheet fed from the feeder 2 onto a feeder board 15 is gripped by a swing arm shaft pregripper 16 and then gripping-changed to the gripper of a transfer cylinder 17. The sheet gripping-changed to the gripper of the transfer cylinder 17 is gripping-changed to the gripper of the impression cylinder 10*a* of the obverse printing unit 6A and printed with the first color on its obverse as the sheet passes through the opposing point (contact point) of the impression cylinder 10*a* and blanket cylinder 11*a*. Then, the sheet printed with the first color on the obverse is gripping-changed to the impression cylinder 10*b* of the reverse printing unit 7A and printed with the first color on its reverse as the sheet passes through the opposing point of the impression cylinder 10*b* and blanket cylinder 11*b*.

Subsequently, the sheet which is sequentially printed with the second to fourth colors on each of its obverse and reverse by the obverse printing units 6B to 6D and reverse printing units 7B to 7D is coated with varnish on the obverse and reverse by the coating unit 4. The coated sheet is gripping-changed to the delivery gripper (not shown) of a delivery chain 19 of the delivery unit 5 and conveyed by the delivery chain 19. The sheet conveyed by the delivery chain 19 serving as a delivery pile is dropped onto a delivery pile 20 and stacked there.

[Coating Unit]

Figure 2:
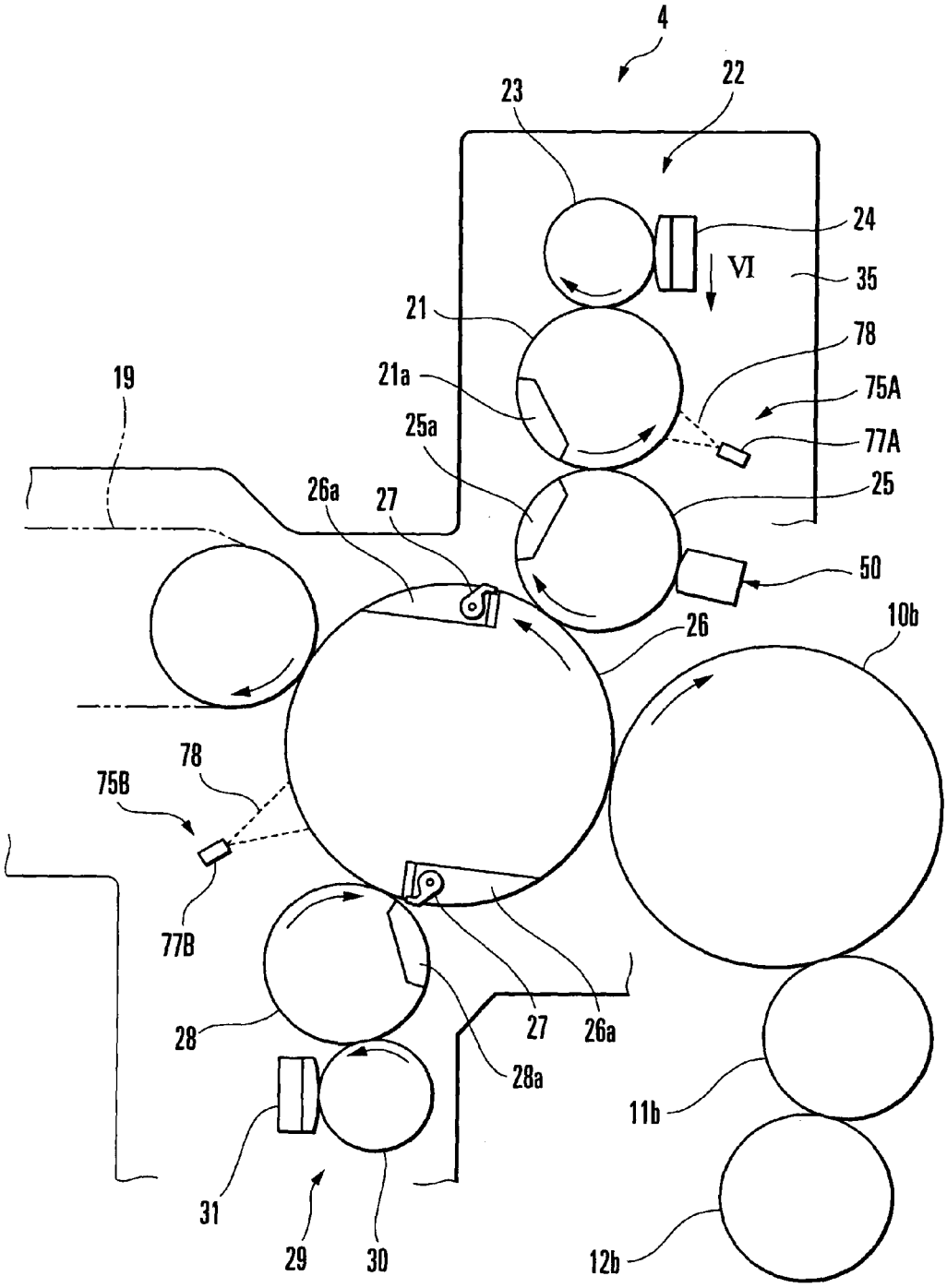
FIG. 2 is a side view of a coating device to which a cleaning apparatus according to an embodiment of the present invention is applied.

The coating unit 4 will be described with reference to FIG. 2. As shown in FIG. 2, an upper plate cylinder 21 (first cylinder) has a notch 21*a* extending in the axial direction in part of its circumferential surface. A varnish supply device 22 (first liquid supply means) which supplies the varnish to the upper plate cylinder 21 comprises an anilox roller 23 which is arranged to oppose the upper plate cylinder 21 and a chamber coater 24 which supplies the varnish to the anilox roller 23. An upper blanket cylinder 25 (second cylinder) arranged to oppose the upper plate cylinder 21 and a blanket cylinder 26 (third cylinder) has a notch 25*a* extending in the axial direction in part of its circumferential surface.

The blanket cylinder 26 has notches 26*a* extending in the axial direction at positions that halve the circumferential surface in the circumferential direction. Each notch 26*a* is provided with a gripper unit 27 (sheet holding means) having a gripper pad, which grips and conveys the sheet, and a gripper. A lower plate cylinder 28 (fourth cylinder) arranged to oppose the blanket cylinder 26 has a notch 28*a* extending in the axial direction in part of its circumferential surface. A varnish supply device 29 (second liquid supply means) which supplies the varnish to the lower plate cylinder 28 comprises an anilox roller 30 arranged to oppose the lower plate cylinder 28, and a chamber coater 31 which supplies the varnish to the anilox roller 30.

The blanket cylinder 26 is arranged to oppose the impression cylinder 10*b* of the reverse printing unit 7D which serves as the most-downstream transport cylinder of the printing unit 3 in the sheet convey direction. The upper blanket cylinder 25 and blanket cylinder 26 are arranged to oppose each other in the downstream sheet convey direction from a position where the impression cylinder 10*b* of the reverse printing unit 7D opposes the blanket cylinder 26. The lower plate cylinder 28 and blanket cylinder 26 are arranged to oppose each other in the upstream sheet convey direction from a position where the impression cylinder 10*b* of the reverse printing unit 7D opposes the blanket cylinder 26.

In this arrangement, the varnish supplied from the chamber coater 24 to the anilox roller 23 is transferred to the upper blanket cylinder 25 through the upper plate cylinder 21. When the printed sheet passes through the opposing point of the upper blanket cylinder 25 and blanket cylinder 26, its obverse (one surface) is coated. Simultaneously, the varnish transferred from the lower plate cylinder 28 to the circumferential surface of the blanket cylinder 26 by the printing pressure of the upper blanket cylinder 25 coats the reverse (the other surface) of the printed sheet.

[Blanket Cylinder Throw-On/Off Mechanism]

Figure 3:
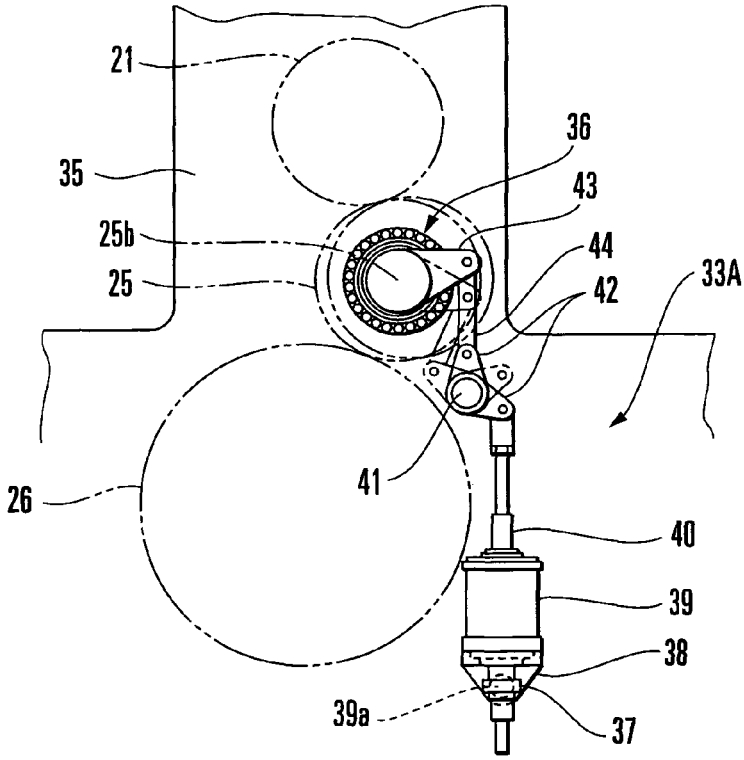
FIG. 3 is a side view of the main part showing a throw-on/off mechanism for an upper blanket cylinder shown in FIG. 2.

Two cylinder throw-on/off mechanisms which throw on/off the upper blanket cylinder 25 and lower plate cylinder 28 will be described with reference to FIG. 3. As these cylinder throw-on/off mechanisms have the same structure, only an upper blanket cylinder throw-on/off mechanism 33A which engages/releases the upper blanket cylinder 25 will be described in detail. A lower plate cylinder throw-on/off mechanism 33B (FIG. 7) which throws on/off the lower plate cylinder 28 will be briefly described where necessary.

A pair of frames 35 arranged to oppose each other at a predetermined gap rotatably, axially support the two end shafts of each of the blanket cylinder 26 and upper plate cylinder 21 through bearings (not shown). Eccentric bearings 36 fitted on the pair of frames 35 rotatably, axially support two end shafts 25*b* of the upper blanket cylinder 25. A stud 37 projecting outward from one frame 35 near one end shaft of the blanket cylinder 26 supports a bracket 38. A stepping motor 39 serving as a driving device is attached to the bracket 38 with a driving rod 40 standing vertically.

When a nut 39*a* is driven by the stepping motor 39 to rotate, the driving rod 40 with a threaded portion threadably engaging with the nut 39*a* vertically moves. A connecting lever 42 having an L shape when seen from the front is axially mounted on the projecting portion of a lever shaft 41 which is located above the driving rod 40 and the two ends of which are axially supported by the pair of frames 35.

Each eccentric bearing 36 has an outer ring (not shown) fitted with a housing mounted in the bearing hole of the corresponding frame 35 through a needle roller and an inner ring (not shown) rotatably fitted in the outer ring through a tapered roller. A bearing lever 43 fixed to the outer ring of the eccentric bearing 36 is connected to the connecting lever 42 through a rod 44. When the driving rod 40 is driven by the stepping motor 39 to move forward/backward, the eccentric bearing 36 pivots through the connecting lever 42, rod 44, and bearing lever 43.

The axis of the inner circumferential surface of the inner ring that constitutes the eccentric bearing 36 is eccentric from that of the outer circumferential surface of the outer ring that constitutes the eccentric bearing 36 by a predetermined distance. Accordingly, in the thrown-on state of the upper blanket cylinder 25, when the rod 40 of the stepping motor 39 moves backward, the axis of the inner circumferential surface of the inner ring moves about the axis of the outer circumferential surface of the outer ring as the center. Accordingly, the upper blanket cylinder 25 is spaced apart from the blanket cylinder 26 and upper plate cylinder 21 to form a gap between the two cylinders 21 and 26, thus performing impression throw-off.

The eccentric bearing (not shown) of the lower plate cylinder 28 is provided with a similar mechanism which is driven by a stepping motor (not shown) to pivot the eccentric bearing. Accordingly, regarding the lower plate cylinder 28 as well, when the eccentric bearing pivots upon rotation of the stepping motor, the lower plate cylinder 28 is spaced apart from the blanket cylinder 26 to form a gap with respect to the blanket cylinder 26, thus performing impression throw-off.

[Anilox Roller Throw-on/off Mechanism]

Figure 4:
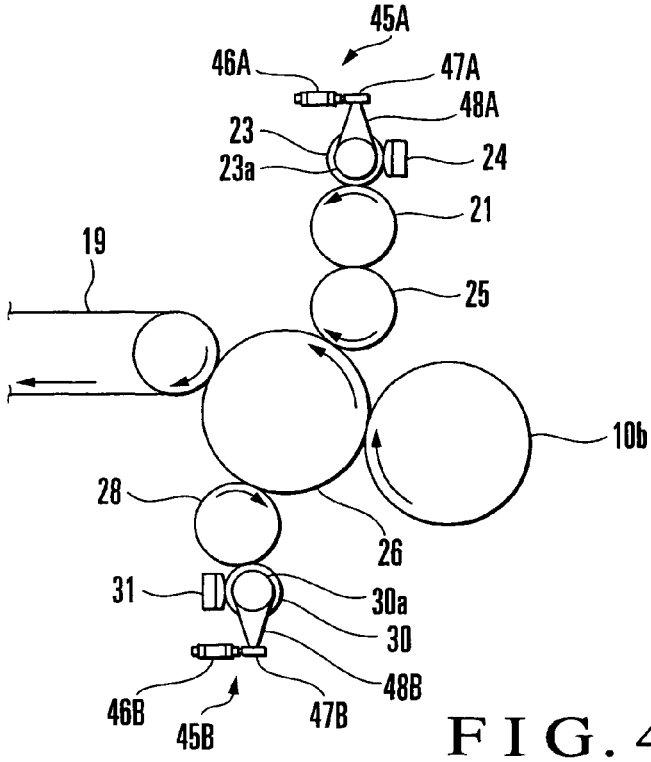
FIG. 4 is a side view of the main part showing a throw-on/off mechanism for an anilox roller shown in FIG. 2.

An upper anilox roller throw-on/off mechanism 45A which throws the anilox roller 23 which forms the varnish supply device 22 on/off the upper plate cylinder 21, and a lower anilox roller throw-on/off mechanism 45B which throws the anilox roller 30, forming the varnish supply device 29, on/off the lower plate cylinder 28 will be described with reference to FIG. 4. First, the upper anilox roller throw-on/off mechanism 45A will be described.

The anilox roller 23 is pivotally supported by the frames 35 through eccentric bearings 23*a*. The proximal end of a bearing lever 48A is fixed to the outer ring of the corresponding eccentric bearing 23*a*. The swing end of the bearing lever 48A is pivotally mounted on a rod 47A of an air cylinder 46A the cylinder end of which is pivotally mounted on the corresponding frame 35. In this arrangement, when the rod 47A of the air cylinder 46A moves forward/backward, the anilox roller 23 is thrown on/off the upper plate cylinder 21 through the bearing lever 48A.

The lower anilox roller throw-on/off mechanism 45B will be described. The anilox roller 30 is pivotally supported by the frames 35 through eccentric bearings 30*a*. The proximal end of a bearing lever 48B is fixed to the outer ring of the corresponding eccentric bearing 30*a*. The swing end of the bearing lever 48B is pivotally mounted on a rod 47B of an air cylinder 46B the cylinder end of which is pivotally mounted on the corresponding frame 35. In this arrangement, when the rod 47B of the air cylinder 46B moves forward/backward, the anilox roller 30 is thrown on/off the lower plate cylinder 28 through the bearing lever 48B.

[Cleaning Apparatus]

Figure 5A:
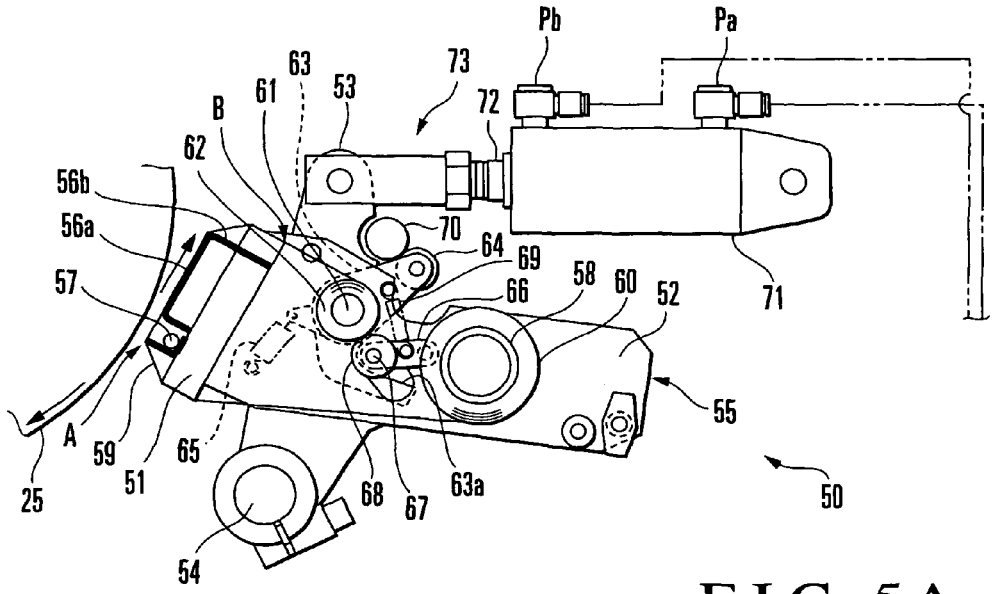
FIGS. 5A and 5B are views showing a non-cleaning state and cleaning state, respectively, of the cleaning apparatus shown in FIG. 2.
Figure 5B:
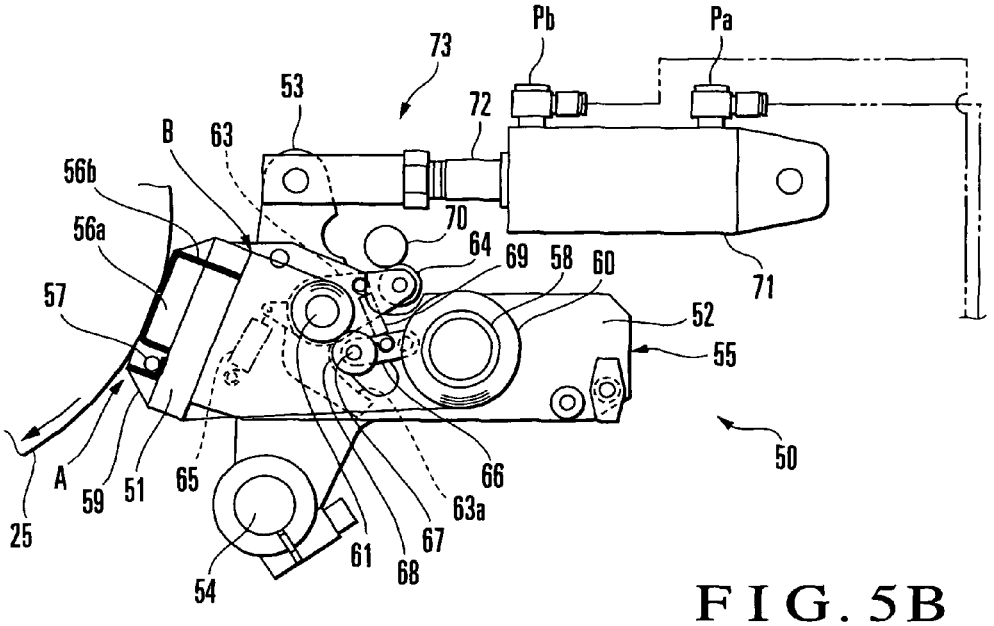

A cleaning apparatus 50 will be described with reference to FIG. 2 and FIGS. 5A and 5B. As shown in FIG. 2, the cleaning apparatus 50 is arranged upstream of a position where the upper blanket cylinder 25 opposes the blanket cylinder 26 in the rotational direction of the upper blanket cylinder 25, to be close to the circumferential surface of the upper blanket cylinder 25. As shown in FIGS. 5A and 5B, the cleaning apparatus 50 comprises a pair of unit frames 52 attached to a stay 51, serving as a contact member and guide member, to be parallel to each other.

The lower end of a driving lever 53 is fixed to a shaft 54 which is pivotally supported between the frames 35. A cleaning unit 55 having the stay 51 and the pair of unit frames 52 is detachably fixed to the driving lever 53. A cleaning plate 56*a* with a U-shaped section and serving as a contact member and press member, which has almost the same width as that of the upper blanket cylinder 25, is attached to the stay 51 to be almost parallel to the upper blanket cylinder 25. A cleaning nozzle 57 (third cleaning liquid supply means) which discharges solvent and water is attached to the stay 51.

A supply roller 60 comprising a cylindrical supply shaft 58 and a cleaning web 59 which is wound around the supply shaft 58 in advance is axially supported at almost the center of the pair of unit frames 52 to be rotatable and detachable. A take-up roller 62 comprising a cylindrical take-up shaft 61 and the cleaning web 59 which is to be taken up around the take-up shaft 61 is axially supported between the pair of unit frames 52, at a position closer to the upper blanket cylinder 25 than the shaft member 58, to be rotatable and detachable. The cleaning web 59 is guided by the end face of the stay 51 and the cleaning plate 56*a* and taken up by the take-up roller 62. At this time, the end face of the stay 51 serves as a guide portion.

A cleaning web take-up lever 63 has an almost V-shaped cam surface 63*a*. A roller 64 is pivotally mounted on one end of the lever 63. The central portion of the lever 63 is connected to the take-up shaft 61 through a one-way clutch (not shown). The lever 63 transmits to the take-up shaft 61 the pivot motion only in a direction to take up the cleaning web 59, i.e., clockwise in FIGS. 5A and 5B, through the one-way clutch. The pulling force of a tensile coil spring 65 biases the lever 63 in such a direction that the roller 64 comes close to a pin 70.

A roller 68 is pivotally mounted on one end of a constant-pitch-feed lever 66 through a shaft 67. The other end of the lever 66 is pivotally, axially supported by one unit frame 52. The pulling force of a tensile coil spring 69 urges the roller 68 against the take-up roller 62, so the shaft 67 engages with the cam surface 63*a* of the lever 63. In this arrangement, as the take-up shaft 61 takes up the cleaning web 59 and the diameter of the take-up roller 62 increases, the roller 68 moves in a direction to separate from the axis of the take-up shaft 61, so the lever 66 pivots counterclockwise.

This changes the engaging position of the shaft 67 and the cam surface 63*a* of the lever 63, thus enlarging the gap between a pin 70 and the roller 64 which is pivotally mounted on the lever 63. As a result, the pivot angle of the lever 63 which pivots each time an actuation rod 72 of an air cylinder 71 moves forward changes in accordance with the outer diameter of the take-up roller 62. More specifically, when the gap between the roller 64 and pin 70 enlarges, the pivot angle of the lever 63 which pivots each time the actuation rod 72 of the air cylinder 71 moves forward decreases. Therefore, the amount of the cleaning web 59 taken up by the take-up shaft 61, that is, the feed amount of the cleaning web 59 is always constant regardless of the outer diameter of the take-up roller 62.

The pin 70 which abuts against the lever 63 to actuate it extends vertically between the frames 35. The air cylinder 71 (moving means/cleaning unit throw-on/off means) moves the cleaning web 59 in directions to come into contact with and separate from the upper blanket cylinder 25, and throws the cleaning unit 55 on/off the upper blanket cylinder 25. The air cylinder 71 has the actuation rod 72 that can move forward/backward. The upper end of the driving lever 53 is pivotally mounted on the distal end of the actuation rod 72. The air cylinder 71 has two ports Pa and Pb. When air is supplied to the port Pa, the actuation rod 72 moves forward. When air is supplied to the port Pb, the actuation rod 72 moves backward. The air cylinder 71 constitutes a switching means for switching the cleaning/non-cleaning operation of the cleaning apparatus.

When the actuation rod 72 moves forward from the non-cleaning state shown in FIG. 5A, the driving lever 53 pivots counterclockwise about the shaft 54 as the center, and the cleaning unit 55 moves in the direction to come close the upper blanket cylinder 25. Hence, as shown in FIG. 5B, the cleaning plate 56*a* urges the cleaning web 59 against the circumferential surface of the upper blanket cylinder 25. At this time, as the cleaning unit 55 moves, the roller 64 abuts against the pin 70, so the lever 63 pivots clockwise. Hence, the take-up shaft 61 pivots clockwise to take up the cleaning web 59.

In this manner, the air cylinder 71, lever 63, roller 64, and pin 70 constitute a feeding mechanism 73 (feed means) which causes the cleaning web 59 to travel. By controlling the amount of air to be supplied to the port Pa, the cleaning unit 55 can be stopped immediately before the cleaning web 59 comes into contact with the circumferential surface of the upper blanket cylinder 25.

When the actuation rod 72 moves backward from the cleaning state shown in FIG. 5B, the driving lever 53 pivots clockwise about the shaft 54 as the pivot center, and the cleaning web 59 separates together with the cleaning unit 55 from the circumferential surface of the upper blanket cylinder 25, as shown in FIG. 5A. When the cleaning unit 55 moves, the pulling force of the tensile coil spring 65 pivots the lever 63 counterclockwise. Thus, the roller 64 is restored to the original position to form a gap between the roller 64 and pin 70.

[Cleaning Liquid Supply Device]

A cleaning liquid supply device 75A (first cleaning liquid supply means) which supplies the cleaning liquid to the circumferential surface of the upper plate cylinder 21, and a cleaning liquid supply device 75B (second cleaning liquid supply means) which supplies the cleaning liquid to the circumferential surface of the blanket cylinder 26 will be described with reference to FIGS. 2 and 6. As the two cleaning liquid supply devices 75A and 75B have the same structure, only the cleaning liquid supply device 75A will be described in detail, and the second cleaning liquid supply device 75B will be described where necessary.

Figure 6:
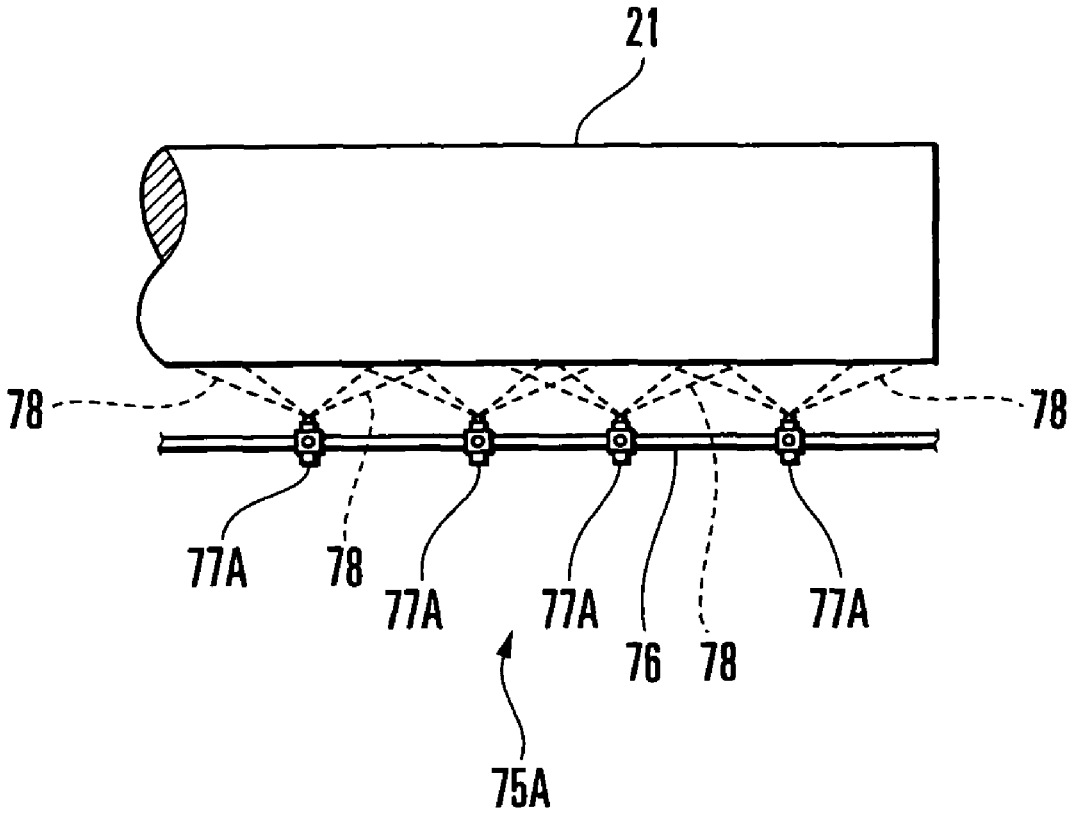
FIG. 6 is a view seen from the direction of an arrow VI in FIG. 2.

As shown in FIG. 6, a stay 76 horizontally extends between the pair of frames 35 such that its axial direction is parallel to that of the upper plate cylinder 21. In the cleaning liquid supply device 75A, a plurality of upper sprays 77A are attached to the stay 76 at predetermined intervals to oppose the upper plate cylinder 21 throughout the entire axial direction. When air is supplied to the upper sprays 77A, a mistlike cleaning liquid 78 is blown together with the supplied air to the circumferential surface of the upper plate cylinder 21.

Similarly, a stay (not shown) horizontally extends between the pair of frames 35 such that its axial direction is parallel to that of the blanket cylinder 26. In the cleaning liquid supply device 75B, a plurality of lower sprays 77B are attached to the stay at predetermined intervals to oppose the blanket cylinder 26 throughout the entire axial direction. When air is supplied to the lower sprays 77B, the mistlike cleaning liquid 78 is blown together with the supplied air to the circumferential surface of the blanket cylinder 26.

[Electrical Configuration]

Figure 7:
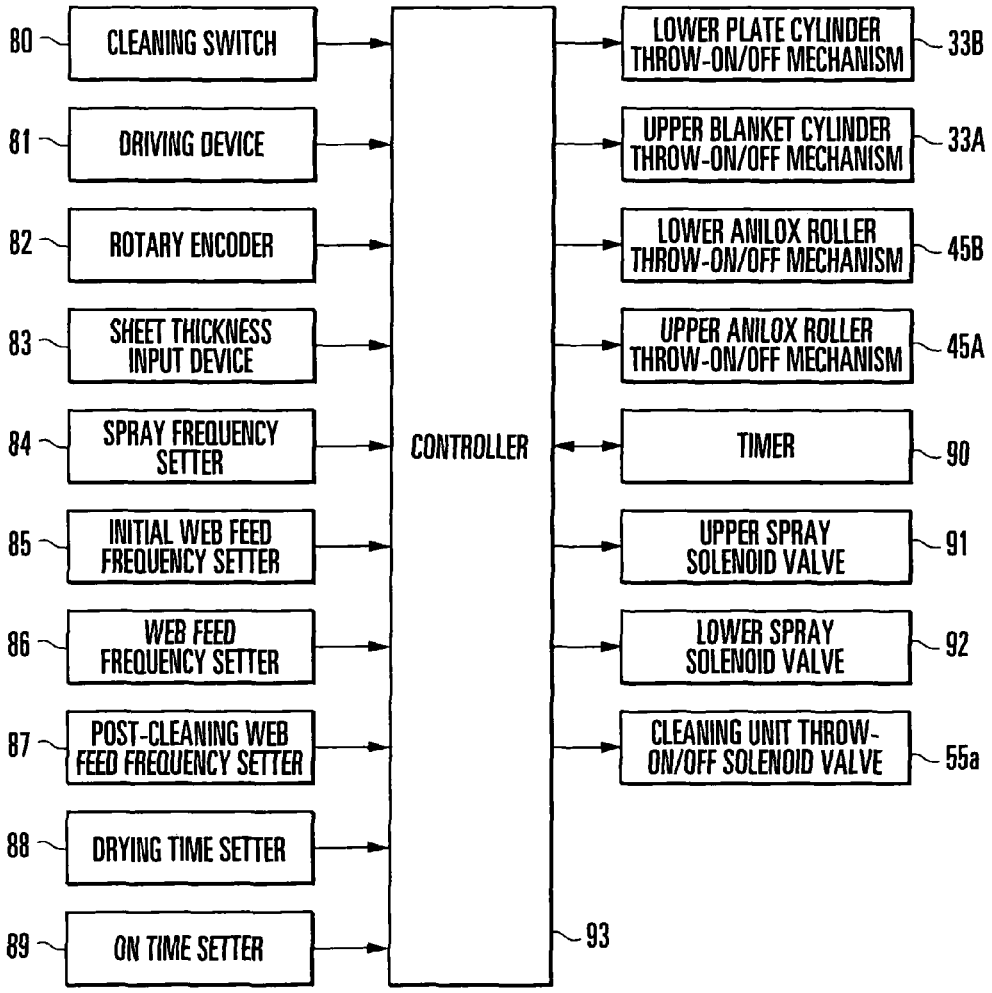
FIG. 7 is a block diagram showing the electrical configuration of the cleaning apparatus shown in FIG. 7.
Figure 8:
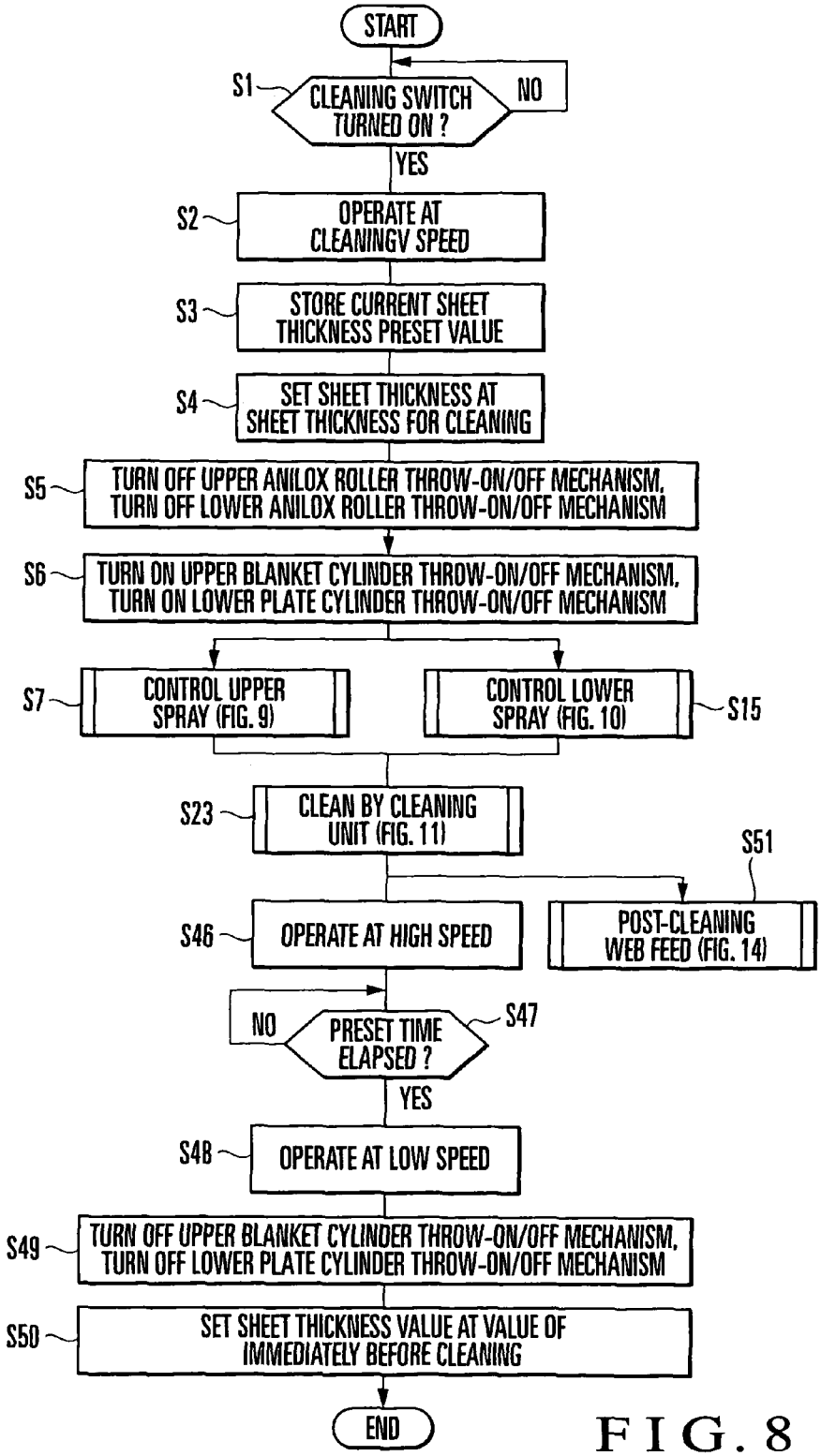
FIG. 8 is a flowchart to briefly explain the cleaning operation of the cleaning apparatus shown in FIG. 7.

The electrical configuration of the apparatus of this embodiment will be described with reference to FIG. 7. The cleaning apparatus according to this embodiment comprises, in addition to the upper blanket cylinder throw-on/off mechanism 33A, lower plate cylinder throw-on/off mechanism 33B, upper anilox roller throw-on/off mechanism 45A, and lower anilox roller throw-on/off mechanism 45B described above, a cleaning unit throw-on/off solenoid valve 55*a*, cleaning switch 80, driving device 81, rotary encoder 82, sheet thickness input device 83, spray frequency setter 84, initial web feed frequency setter 85, web feed frequency setter 86, post-cleaning web feed frequency setter 87, drying time setter 88, cleaning unit ON time setter 89, timer 90, upper spray solenoid valve 91, lower spray solenoid valve 92, and controller 93 which is connected to the respective elements described above.

The cleaning unit throw-on/off solenoid valve 55*a* performs switching between the ports Pa and Pb of the air cylinder 71. The cleaning switch 80 instructs the controller 93 to start cleaning. The driving device 81 drives the printing press on the basis of the control of the controller 93. The rotary encoder 82 (phase detection means) detects the phase of the transfer cylinder 17. The operator inputs the value of the sheet thickness to the sheet thickness input device 83 (thickness input means). The operator sets the frequency or the number of times with which the upper sprays 77A and lower sprays 77B blow the cleaning liquid 78.

The operator sets in the initial web feed frequency setter 85 (initial web feed frequency setting means) the frequency with which the cleaning web 59 is fed before the cleaning apparatus 50 performs cleaning. The feed frequency of the cleaning web 59 during the cleaning operation of the cleaning apparatus 50 is set in the web feed frequency setter 86 (web feed frequency setting means). The feed frequency of the cleaning web 59 after the cleaning operation of the cleaning apparatus 50 is set in the web feed frequency setter 87 (web feed frequency setting means).

The cylinder drying time after the cleaning operation of the cleaning apparatus 50 is set in the drying time setter 88 (drying time setting means). The time during which the cleaning web 59 of the cleaning apparatus 50 is to be urged against the circumferential surface of the upper blanket cylinder 25 is set in the cleaning unit ON time setter 89 (cleaning unit ON time setting means). The timer 90 counts the drying time set in the drying time setter 88 and the time set in the cleaning unit ON time setter 89. The upper spray solenoid valve 91 is opened when supplying air to the upper sprays 77A. The lower spray solenoid valve 92 is opened when supplying air to the lower sprays 77B.

Each of the sheet thickness input device 83, spray frequency setter 84, initial web feed frequency setter 85, web feed frequency setter 86, post-cleaning web feed frequency setter 87, drying time setter 88, and cleaning unit ON time setter 89 comprises a ten-key input device to which the operator inputs desired data. Alternatively, the operator may select an input mode at one ten-key input device, e.g., a personal computer, which has a plurality of inputs modes corresponding to the types of data, and input a necessary type of data. If the value of the data is fixed and only the fixed data need be read out, a memory may be used.

While blowing the cleaning liquid from the upper sprays 77A to the circumferential surface of the upper plate cylinder 21, when the rotary encoder 82 detects the phase of the cleaning liquid blowing range of the upper sprays 77A corresponding to the notch 21*a* of the upper plate cylinder 21, the controller 93 closes the upper spray solenoid valve 91 to stop blowing the cleaning liquid from the upper sprays 77A. Similarly, while blowing the cleaning liquid from the lower sprays 77B to the circumferential surface of the lower plate cylinder 28, when the cleaning liquid rotary encoder 82 detects the phase of the cleaning liquid blowing range of the lower sprays 77B corresponding to the notch 26*a* of the blanket cylinder 26, the controller 93 closes the lower spray solenoid valve 92 to stop blowing the cleaning liquid from the lower sprays 77B. This prevents the cleaning liquid blown from the upper sprays 77A and lower sprays 77B from entering the notches 21*a* and 26*a* of the upper plate cylinder 21 and blanket cylinder 26, respectively.

The controller 93 drives the upper blanket cylinder throw-on/off mechanism 33A to control the gap between the upper blanket cylinder 25 and blanket cylinder 26 during printing to provide a printing pressure corresponding to a sheet thickness input to the sheet thickness input device 83 is obtained.

The controller 93 performs the following control when cleaning the cylinder. Namely, the controller 93 controls the upper blanket cylinder throw-on/off mechanism 33A to throw (bring) the upper blanket cylinder 25 on (into contact with) the upper plate cylinder 21 and blanket cylinder 26. The controller 93 also controls the lower plate cylinder throw-on/off mechanism 33B to throw (bring) the lower plate cylinder 28 on (into contact with) the blanket cylinder 26. The controller 93 turns off the upper anilox roller throw-on/off mechanism 45A so that the anilox roller 23 is thrown off the upper plate cylinder 21. The controller 93 also turns off the upper anilox roller throw-on/off mechanism 45B so that the anilox roller 30 is thrown off the lower plate cylinder 28.

[Cleaning Operation]

The cleaning operation of the cleaning apparatus having the above arrangement will be described with reference to FIGS. 8 to 14. First, the controller 93 detects that the cleaning switch 80 is turned on (YES in step S1). The controller 93 then operates the printing machine by the driving device 81 at a prefixed cleaning speed (step S2). The controller 93 stores the current sheet thickness preset value (step S3). The operator sets (inputs) a sheet thickness in the sheet thickness input device 83 (step S4).

The controller 93 turns off the upper anilox roller throw-on/off mechanism 45A and lower anilox roller throw-on/off mechanism 45B (step S5). Thus, the anilox roller 23 of the first varnish supply device 22 is thrown off the upper plate cylinder 21, and the anilox roller 30 of the second varnish supply device 29 is thrown off the lower plate cylinder 28. The controller 93 turns on the upper blanket cylinder throw-on/off mechanism 33A and lower plate cylinder throw-on/off mechanism 33B (step S6). Thus, the upper blanket cylinder 25 is thrown on the upper plate cylinder 21 and blanket cylinder 26 and the lower plate cylinder 28 is thrown on the blanket cylinder 26 on the basis of the cleaning sheet thickness value set in the sheet thickness input device 83.

In this manner, by setting (inputting) the cleaning sheet thickness value, the contact pressure of the upper blanket cylinder 25 against the blanket cylinder 26 during cleaning becomes a predetermined cleaning pressure having a cleaning function. In this case, a constant cleaning pressure is obtained during cleaning regardless of the sheet thickness value.

[Upper Spray Control]

Figure 9:
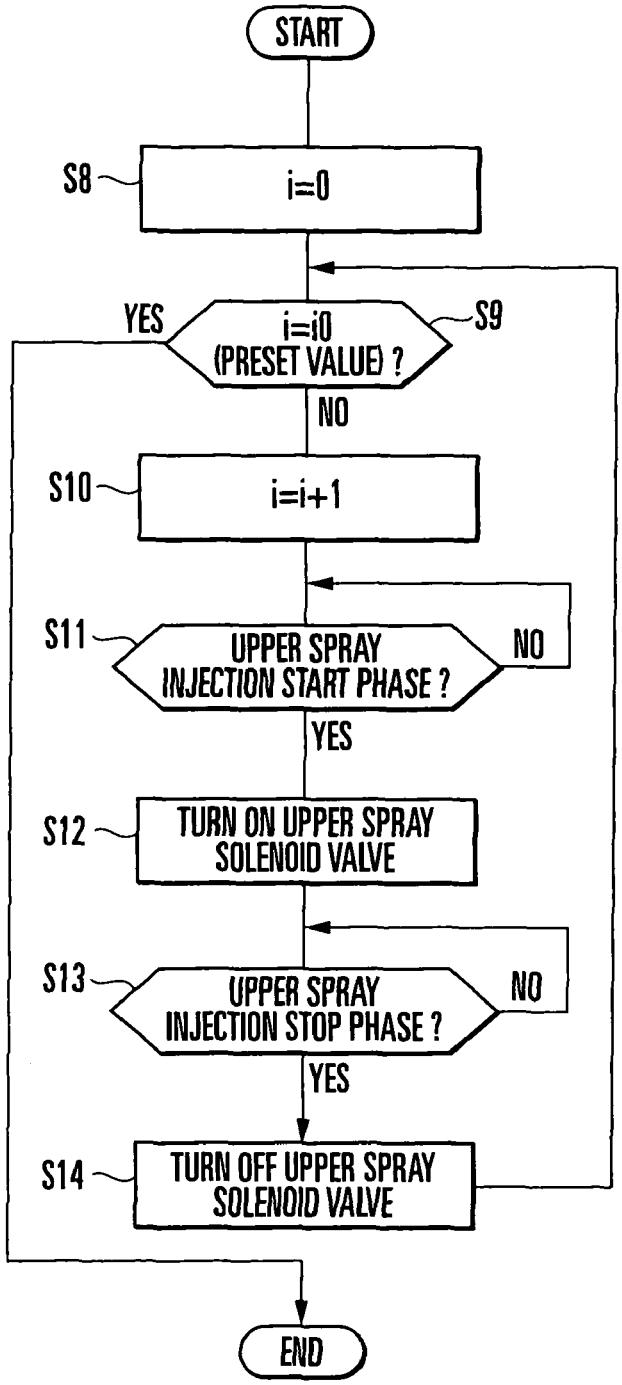
FIG. 9 is a flowchart to explain in detail upper spray control shown in FIG. 8.

The controller 93 then controls the upper sprays 77A of the first cleaning liquid supply device 75A (step S7). FIG. 9 shows step S7 in detail. First, the controller 93 sets the injection frequency "i" of the upper sprays 77A to satisfy i=0 (step S8). If the spray frequency "i" is not the value "i0" preset by the spray frequency setter 84 (NO in step S9), "i" is incremented by "1" (i=i+1) (step S10). If an output from the rotary encoder 82 does not indicate an upper spray injection start phase (NO in step S11), that is, if the cleaning liquid injection range of the upper sprays 77A includes the notch 21*a* of the upper plate cylinder 21, spray injection start is waited until the phase corresponding to the notch 21*a* is ended.

When the upper spray injection start phase is obtained (YES in step S11), that is, when the notch 21*a* of the upper plate cylinder 21 that has opposed the upper sprays 77A passes, the upper spray solenoid valve 91 is turned on (step S12). Thus, the upper sprays 77A blow the mistlike cleaning liquid 78 to the circumferential surface of the upper plate cylinder 21. Then, when the upper spray injection start phase is not obtained (NO in step S13), that is, when the notch 21*a* of the upper plate cylinder 21 does not oppose the upper sprays 77A, spray injection is continued until the notch 21*a* opposes the upper sprays 77A.

When an upper spray stop phase is obtained (YES in step S13), that is, when the notch 21*a* of the upper plate cylinder 21 starts to oppose the upper sprays 77A, the upper spray solenoid valve 91 is turned off (step S14). Thus, injection by the upper sprays 77A is stopped, and the process returns to step S9. If i≠i0 (NO in step S9), steps S10 to S14 are repeated. If i=i0 (YES in step S9), the control operation of the upper sprays 77A is stopped. This prevents the upper sprays 77A from blowing the cleaning liquid to the notch 21*a* of the upper plate cylinder 21.

According to steps S8 to S14, when the upper sprays 77A supply the cleaning liquid 78 to the circumferential surface of the upper plate cylinder 21, as the upper plate cylinder 21 rotates, the cleaning liquid 78 dissolves the varnish attached to the circumferential surface of the upper plate cylinder 21 to decrease its viscosity. The cleaning liquid 78 supplied to the circumferential surface of the upper plate cylinder 21 transfers to the upper blanket cylinder 25 which has been thrown on the upper plate cylinder 21, to decrease the viscosity of the varnish attached to the circumferential surface of the upper blanket cylinder 25 as well.

[Lower Spray Control]

Figure 10:
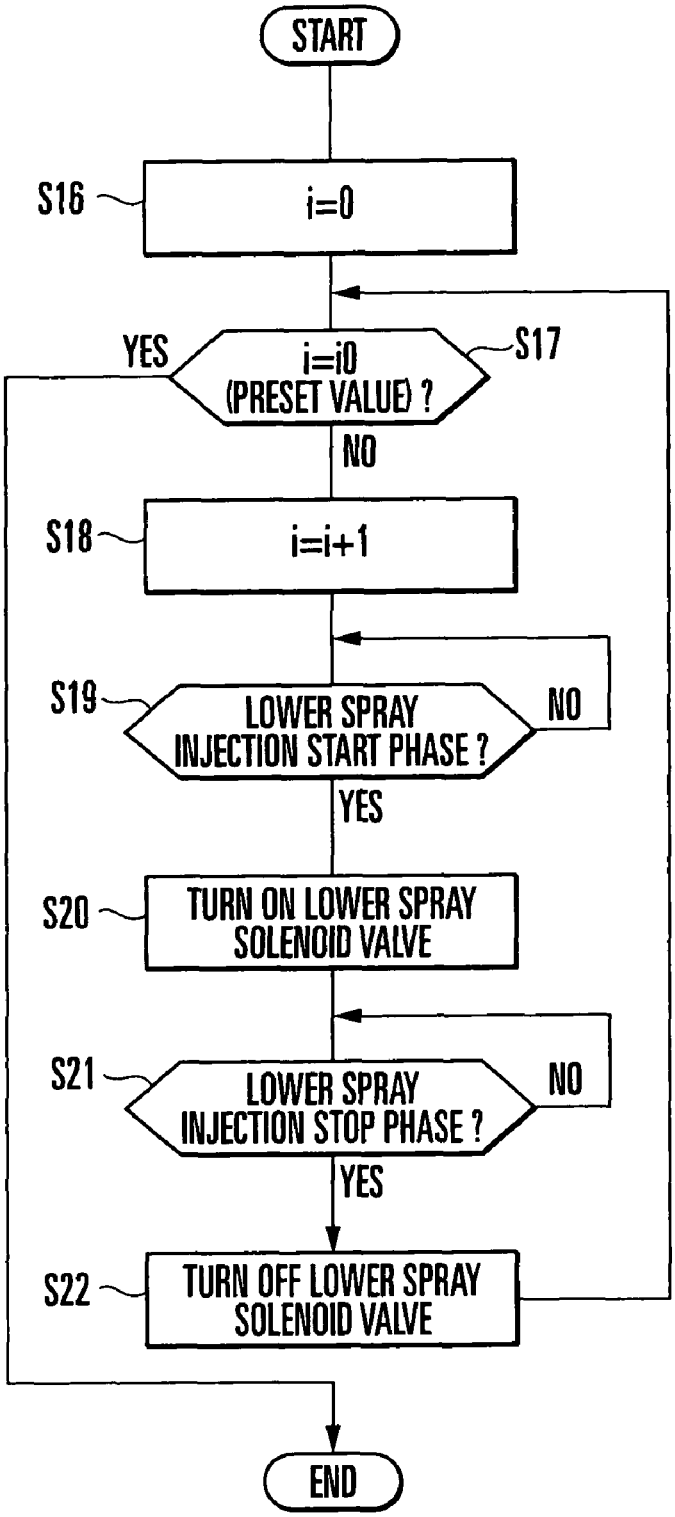
FIG. 10 is a flowchart to explain in detail lower spray control shown in FIG. 8.

The controller 93 controls the lower sprays 77B of the second cleaning liquid supply device 75B (step S15) as well as the upper sprays 77A of the first cleaning liquid supply device 75A (step S7). FIG. 10 shows step S15 in detail. First, the controller 93 sets the injection frequency "i" of the lower sprays 77B to satisfy i=0 (step S16).

If "i" is not the value "i0" preset by the spray frequency setter 84 (NO in step S17), "i" is incremented by "1" (i=i+1). If an output from the rotary encoder 82 does not indicate a lower spray injection start phase, that is, if the cleaning liquid injection range of the lower sprays 77B includes either notch 26*a* of the blanket cylinder 26, spray injection start is waited until the notch 26*a* passes.

When the lower spray injection start phase is obtained (YES in step S17), that is, when the notch 26*a* of the blanket cylinder 26 that has opposed the lower sprays 77B passes, the lower spray solenoid valve 92 is turned on (step S18). Thus, the lower sprays 77B blow the mistlike cleaning liquid 78 to the circumferential surface of the blanket cylinder 26. Then, when the lower spray start phase is not obtained (NO in step S19), that is, when the cleaning liquid injection range of the lower sprays 77B includes the notch 26*a* of the blanket cylinder 26, spray injection is continued until the phase corresponding to the notch 26*a* is ended.

When a lower spray stop phase is obtained (YES in step S21), that is, when the notch 26*a* of the blanket cylinder 26 starts to oppose the lower sprays 77B, the lower spray solenoid valve 92 is turned off (step S22). Thus, injection by the lower sprays 77B is stopped, and the process returns to step S17. If i≠i0 (NO in step S17), the operation of steps S18 to S22 is repeated. If i=i0 (YES in step S17), the control operation of the lower sprays 77B is stopped. This prevents the lower sprays 77B from blowing the cleaning liquid to the notch 26*a* of the blanket cylinder 26.

According to steps S16 to S22, when the lower sprays 77B supply the cleaning liquid 78 to the circumferential surface of the blanket cylinder 26, as the blanket cylinder 26 rotates, the cleaning liquid 78 dissolves the varnish attached to the circumferential surface of the blanket cylinder 26 to decrease its viscosity. The cleaning liquid 78 supplied to the circumferential surface of the blanket cylinder 26 transfers to the lower plate cylinder 28 and upper blanket cylinder 25 which have been thrown on the blanket cylinder 26, to decrease the viscosity of the varnish attached to the circumferential surfaces of the lower plate cylinder 28 and upper blanket cylinder 25 as well.

In the process of steps S8 to S14 of the upper sprays 77A and the process of steps S16 to S22 of the lower sprays 77B, control operation is performed so the cleaning liquid will not be supplied to the notch 21*a* of the upper plate cylinder 21 or the notch 26*a* of the blanket cylinder 26 provided with the gripper or the like. This prevents waste of the cleaning liquid and contamination and rust of the rollers, thus improving the durability.

[Cleaning by Cleaning Unit]

Figure 11:
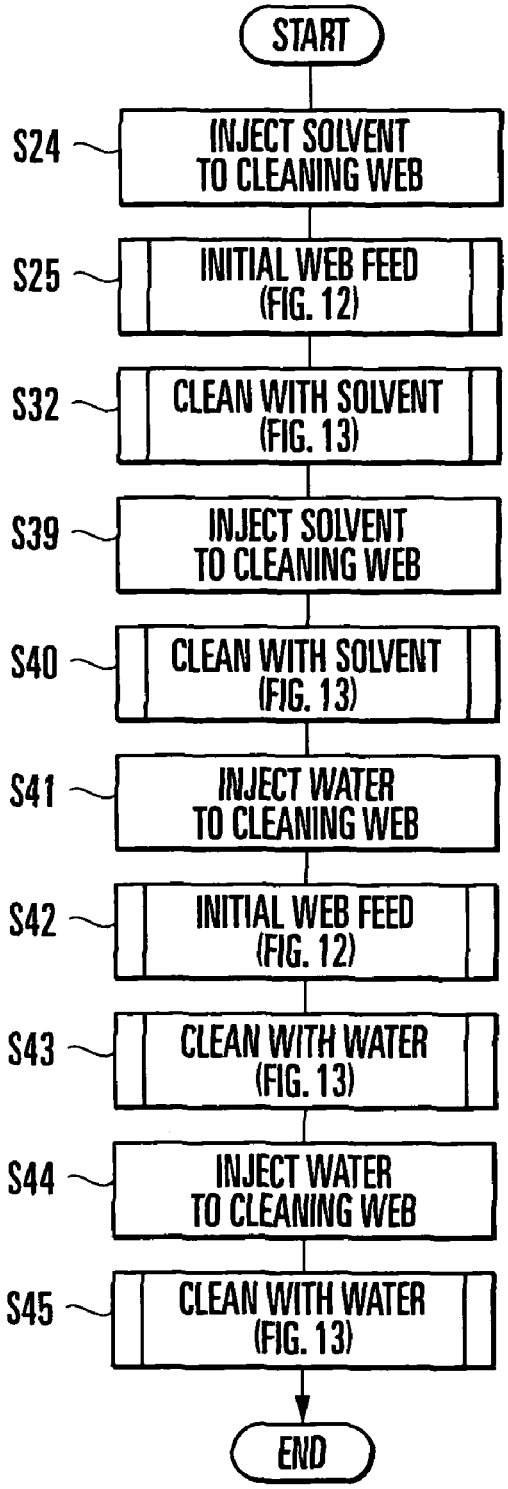
FIG. 11 is a flowchart to explain in detail the cleaning operation of a cleaning unit shown in FIG. 8.

Then, the cleaning unit performs cleaning (step S23). FIG. 11 shows step S23 in detail. First, the cleaning apparatus 50 injects the cleaning liquid 78 to the cleaning web 59 from the cleaning nozzle 57 (step S24).

[First Initial Web Feed]

Figure 12:
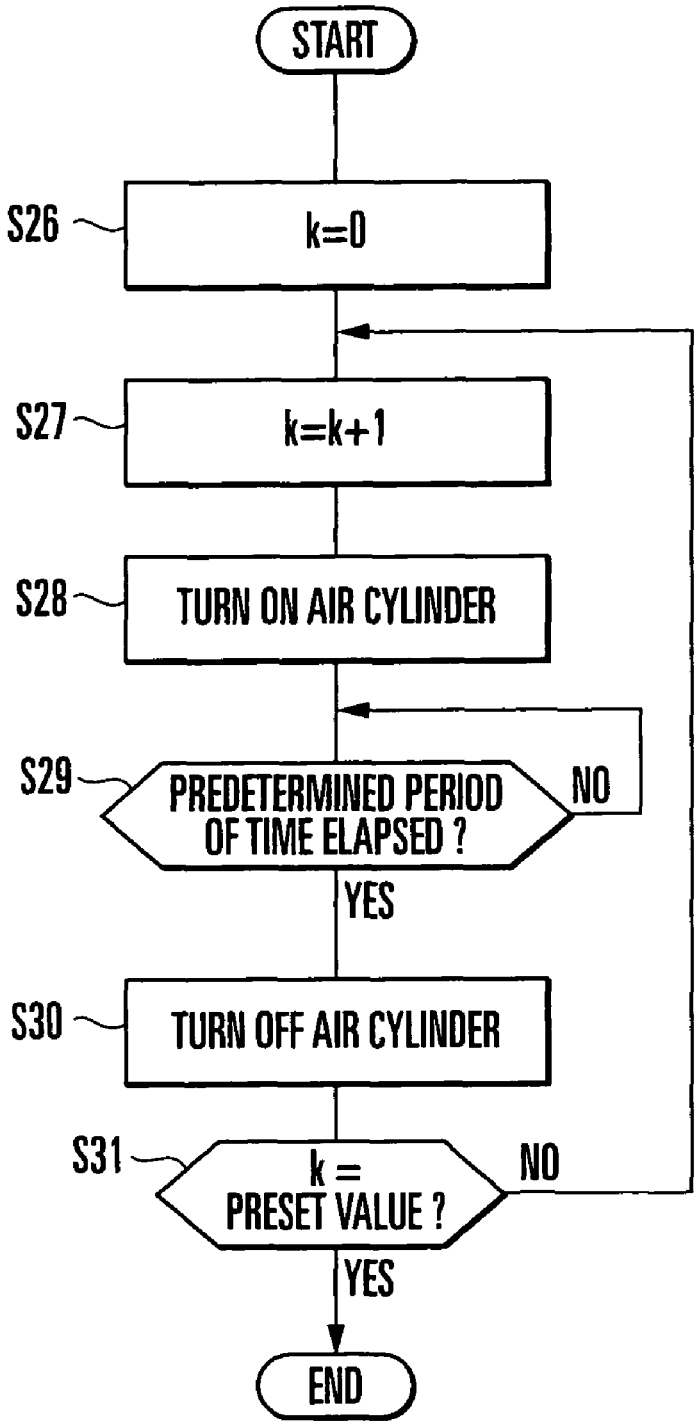
FIG. 12 is a flowchart to explain initial web feed shown in FIG. 11.

Then, initial web feed takes place (step S25). FIG. 12 shows step S25 in detail. First, the web feed frequency "k" is set to satisfy k=0 (step S26). Then, "k" is incremented by "1" (k=k+1) (step S27). The air cylinder 71 is turned on (step S28). More specifically, when the solenoid valve 55*a* is switched, as shown in FIG. 5B, air is supplied to the port Pa of the air cylinder 71 to move the actuation rod 72 forward, and the cleaning plate 56*a* comes close to the circumferential surface of the upper blanket cylinder 25.

It is checked whether the time (throw-on operation time of the air cylinder 71) that the timer 90 counts and lapses until the air cylinder 71 is turned off, before the cleaning web 59 comes into contact with the circumferential surface of the upper blanket cylinder 25, reaches a predetermined period of time (step S29). If the throw-on operation time of the air cylinder 71 does not reach the predetermined period of time (NO in step S29), it is waited until the predetermined period of time elapses. If the throw-on time of the air cylinder 71 reaches the predetermined period of time (YES in step S29), the air cylinder 71 is turned off (step S30).

More specifically, when the solenoid valve 55*a* is switched, as shown in FIG. 5A, air is supplied to the port Pb of the air cylinder 71 to move the actuation rod 72 backward, and the cleaning plate 56*a* is spaced apart from the circumferential surface of the upper blanket cylinder 25. Then, if the preset value "k" does not reach the value (in this case, the preset value "k1" of solvent cleaning) set by the initial web feed frequency setter 85 (NO in step S31), steps S27 to S30 are repeated. If k=preset value is obtained (YES in step S31), initial web feed is ended, and the cleaning web 59 attached with the solvent is fed onto the cleaning plate 56*a*.

According to initial web feed of step S25, the cleaning web 59 travels without coming into contact with the circumferential surface of the cylinder in step S24, and that portion of the cleaning web 59 to which the cleaning liquid 78 has been supplied opposes the circumferential surface of the cylinder. This prevents that portion of the cleaning web 59 which is not soaked with the solvent from coming into contact with the circumferential surface of the cylinder and adhering to it at the start of cleaning.

[First Solvent Cleaning]

Figure 13:
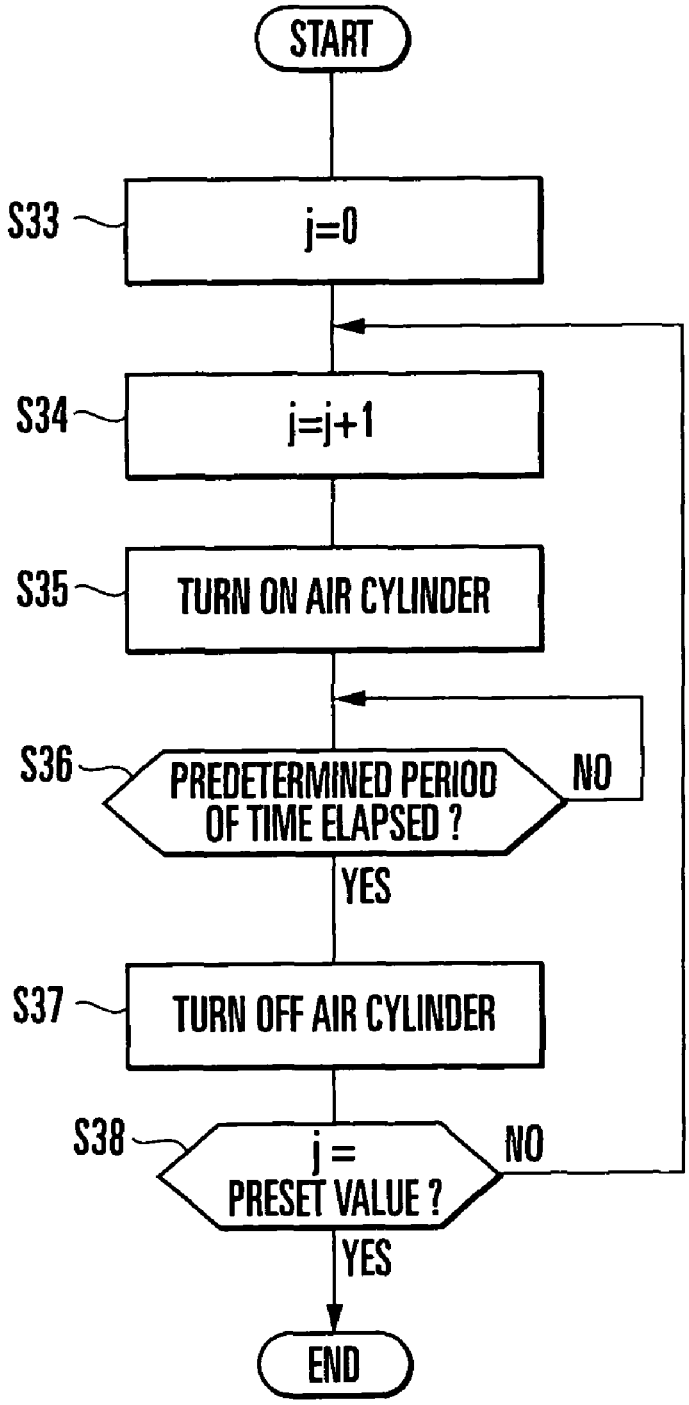
FIG. 13 is a flowchart to explain in detail solvent cleaning and water cleaning shown in FIG. 11.

Subsequent to step S25 shown in FIG. 11, the cleaning apparatus 50 performs first cleaning using the solvent (step S32). FIG. 13 shows step S32 in detail. First, the throw-on frequency "j" of the cleaning unit is set to satisfy j=0 (step S33). Then, "j" is incremented by "1" (j=j+1) (step S34). The air cylinder 71 is turned on (step S35). More specifically, as shown in FIG. 5B, air is supplied to the port Pa of the air cylinder 71 to move the actuation rod 72 forward, and the cleaning plate 56*a* urges the cleaning web 59 against the circumferential surface of the upper blanket cylinder 25 in a still state.

It is checked whether the time (the time during which the cleaning web 59 is in contact with the circumferential surface of the upper blanket cylinder 25) which is counted by the timer 90 and set by the cleaning unit ON time setter 89 reaches a predetermined period of time (step S36). If the throw-on operation time of the air cylinder 71 does not reach the predetermined period of time (NO in step S29), it is waited until the predetermined period of time elapses. If the throw-on time of the air cylinder 71 reaches the predetermined period of time, the air cylinder 71 is turned off (step S37).

More specifically, as shown in FIG. 5A, air is supplied to the port Pb of the air cylinder 71 to move the actuation rod 72 backward, and the cleaning plate 56*a* is spaced apart from the circumferential surface of the upper blanket cylinder 25. Then, if throw-on frequency "j" of the cleaning unit does not reach the preset value (in this case, the preset value "j1" of first solvent cleaning) (NO in step S38), steps S34 to S37 are repeated. If j=preset value is obtained in step S38, cleaning is ended.

During the cleaning operation of the cleaning apparatus 50 in steps S33 to S38, the upper blanket cylinder 25 is kept thrown on the upper plate cylinder 21 and blanket cylinder 26, and the lower plate cylinder 28 is kept thrown on the blanket cylinder 26. Thus, the varnish or contamination on the upper plate cylinder 21, blanket cylinder 26, and lower plate cylinder 28 is transferred to the upper blanket cylinder 25 and cleaned by the cleaning apparatus 50.

According to this embodiment, each of the cylinders 21, 25, 26, and 28 to be cleaned need not be provided with an individual cleaning apparatus 50, but one cleaning apparatus can clean the plurality of cylinders. This can reduce the cost and the space to install the cleaning apparatus. Since the cleaning apparatus 50 cleans the cylinders 21, 25, 26, and 28 simultaneously, waste paper due to cleaning by printing is not produced. Hence, the cost does not increase, and the operation of removing the waste paper from the delivery pile becomes unnecessary, thus reducing the load to the operator.

During the cleaning operation of the cleaning apparatus 50 in steps S33 to S38, supply of the cleaning liquid 78 from the cleaning liquid supply devices 75A and 75B is stopped. Alternatively, the cleaning liquid 78 is continuously supplied during the cleaning operation as well.

Subsequent to step S32 shown in FIG. 11, the cleaning apparatus 50 injects the solvent to the cleaning web 59 from its cleaning nozzle (step S39).

[Second Solvent Cleaning]

Then, the cleaning apparatus 50 performs second cleaning using the solvent (step S40). FIG. 13 shows step S40 in detail. As the second cleaning is almost the same as the first cleaning (step S32), only the difference will be described. In step S38 in FIG. 13, whether or not the preset value "j" has reached the preset value "j2" of second solvent cleaning is checked.

In the second cleaning operation (step S40), the preset value "j2" of the throw-on frequency of the cleaning unit is set to be larger than that of the preset value "j1" of the first cleaning operation (step S32). This is due to the following reason. In the second cleaning, the throw-on frequency of the cleaning unit is set larger than that of the first cleaning operation (the cleaning time of the cleaning apparatus 50 is prolonged), so that when wiping the contamination and cleaning liquid attached to the circumferential surface of the cylinder, cleaning with water can be performed after the solvent of the cleaning liquid 78 is dried sufficiently.

In this manner, when water cleaning is performed after the solvent of the cleaning liquid 78 attached to the cylinder is dried, the contamination can be prevented from depositing on the cylinder to remain as a solid can be prevented. More specifically, when cleaning off the varnish on the cylinder, if water cleaning is performed with the solvent in the cleaning liquid 78 not dried but remaining on the cylinder, the solvent, water, and varnish mix. In this case, the solvent, water, and varnish solidify and deposit on the cylinder. To remove the deposit, the cylinder must be further cleaned manually.

Subsequent to step S40 in FIG. 11, the cleaning apparatus 50 injects water to the cleaning web 59 from its cleaning nozzle 57 (step S41).

[Second Initial Web Feed]

Then, second initial web feed is performed (step S42). The operation of the second initial web feed is the same as that of the first initial web feed (step S25) and a repetitive description thereof will be omitted.

[First Water Cleaning]

Subsequent to step S42 in FIG. 11, the cleaning apparatus 50 performs first cleaning using water (step S43). FIG. 13 shows step S43 in detail. As the first water cleaning is almost the same as the first solvent cleaning (step S32), only the difference will be described. In step S38 in FIG. 13, whether or not the preset value "j" has reached the preset value "j3" of the first water cleaning is checked.

Returning to FIG. 11, in step S44, the cleaning apparatus 50 injects water to the cleaning web 59 from its cleaning nozzle (step S44).

[Second Water Cleaning]

Subsequent to step S44 in FIG. 11, the cleaning apparatus 50 performs second water cleaning. FIG. 13 shows step S43 in detail. As the second cleaning with water is almost the same as the first solvent cleaning (step S32), only the difference will be described. In step S38 in FIG. 13, whether or not the preset value "j" has reached the preset value "j4" of the second water cleaning is checked.

In this manner, in steps S7 and S15, the cleaning liquid is supplied to the circumferential surfaces of the upper plate cylinder 21 and blanket cylinder 26. At this time point, the respective cylinders 21, 25, 26, and 28 are not cleaned by the cleaning apparatus 50 but rotated. Thus, the varnish attached to the circumferential surface of each of the plurality of cylinders 21, 25, 26, and 28 which are kept thrown on each other and are thus continuous to each other dissolves, so its viscosity decreases. After that, the cylinders 21, 25, 26, and 28 are cleaned by the cleaning apparatus 50. This facilitates removal of the varnish and contamination, thus shortening the cleaning time.

Referring back to FIG. 8, the controller 93 controls the driving device 81 to operate the printing press at a high speed so as to dry the circumferential surfaces of the upper plate cylinder 21, upper blanket cylinder 25, blanket cylinder 26, and lower plate cylinder 28 that are cleaned (step S46). The printing press continues high-speed operation until the time preset by the drying time setter 88 elapses (step S47).

When the preset time elapses (YES in step S47), the controller 93 controls the driving device 81 to switch the printing press to low-speed operation (step S48). Then, the controller 93 turns off the upper blanket cylinder throw-on/off mechanism 33A and lower plate cylinder throw-on/off mechanism 33B, so that the upper blanket cylinder 25 and lower plate cylinder 28 are thrown off the blanket cylinder 26. The controller 93 then sets the sheet thickness value to the stored value of immediately before cleaning.

[Post-Cleaning Web Feed]

Figure 14:
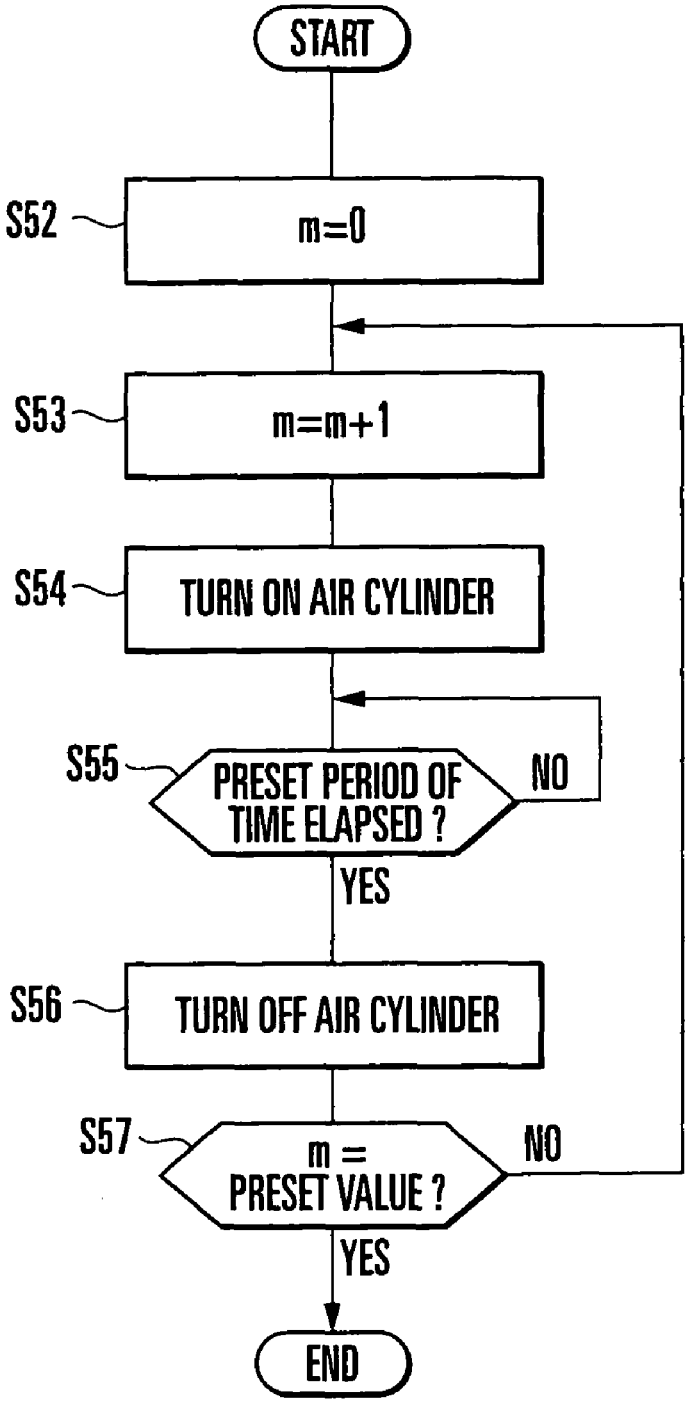
FIG. 14 is a flowchart to explain in detail post-cleaning web feed shown in FIG. 8.

When the printing press is operated at a high speed in step S46, post-cleaning web feed is performed simultaneously (step S51). FIG. 14 shows step S51 in detail. First, the web feed frequency "m" is set to satisfy m=0 (step S52). Then, "m" is incremented by "1" (m=m+1) (step S53). The air cylinder 71 is turned on (step S54). More specifically, when the solenoid valve 55*a* is switched, as shown in FIG. 5B, air is supplied to the port Pa of the air cylinder 71 to move the actuation rod 72 forward, and the cleaning plate 56*a* comes close to the circumferential surface of the upper blanket cylinder 25.

It is checked whether the time (throw-on operation time of the air cylinder 71) that the timer 90 counts and lapses until the air cylinder 71 is turned off, before the cleaning web 59 comes into contact with the circumferential surface of the upper blanket cylinder 25, reaches a predetermined period of time (step S55). If the throw-on operation time of the air cylinder 71 does not reach the predetermined period of time (NO in step S55), it is waited until the predetermined period of time elapses. If the throw-on time of the air cylinder 71 reaches the predetermined period of time (YES in step S55), the air cylinder 71 is turned off (step S56). Thus, the cleaning unit 55 is spaced apart from the upper blanket cylinder 25 immediately before the cleaning web 59 comes into contact with the upper blanket cylinder 25.

More specifically, when the solenoid valve 55*a* is switched, as shown in FIG. 5A, air is supplied to the port Pb of the air cylinder 71 to move the actuation rod 72 backward, and the cleaning plate 56*a* is spaced apart from the circumferential surface of the upper blanket cylinder 25. Then, if "m" does not reach the value set by the post-cleaning web feed frequency setter 87 for initial web feed (NO in step S57), steps S53 to S56 are repeated. If m=preset value is obtained (YES in step S57), post-cleaning web feed is ended.

When the air cylinder 71 repeats the ON/OFF operation m times, the cleaning web 59 travels for a predetermined length (a travel length of one operation of the air cylinder 71×m) in noncontact with the circumferential surface. The predetermined length refers to a length which is equal to or larger than the length (the length from point A to point B in FIGS. 5A and 5B) with which the cleaning web 59 is in contact with the stay 51, the cleaning plate 56*a*, and a guide member 56*b* as the contact members and with which the cleaning web 59 can wipe the contamination transferred to the stay 51, cleaning plate 56*a*, and guide member 56*b*. The predetermined length of the cleaning web 59 corresponds to a clean (unused) portion of the cleaning web 59 which comes into contact with the contact members to wipe their contamination.

In this manner, immediately after cleaning by the cleaning unit is ended in step S23, the cleaning web 59 is driven to travel for the predetermined length in step S51. This can prevent the contamination removed from the circumferential surface of the upper blanket cylinder 25 from being attached to the cleaning web 59 to stick the cleaning web 59 to the stay 51, cleaning plate 56*a*, and guide member 56*b*. Hence, when performing the cleaning operation the next time, the cleaning web 59 can be prevented from failing to travel. This can prevent deformation of a cleaning pad 56 or any damage to the cleaning apparatus 50.

After the traveling cleaning web 59 travels to clean the upper blanket cylinder 25 in step S51, before the contamination attached to the cleaning web 59 sticks to the stay 51, cleaning plate 56*a*, and guide member 56*b*, the contaminated cleaning web 59 can be spaced apart from the stay 51, cleaning plate 56*a*, and guide member 56*b*. Therefore, the varnish, contamination, and the like attached to the cleaning web 59 will not solidify on the stay 51, cleaning plate 56*a*, and guide member 56*b*. Hence, unlike in the conventional case, the operation of manually removing the varnish or contamination attached to and solidifying on the stay 51, cleaning plate 56*a*, and guide member 56*b* becomes unnecessary, thus reducing the load to the operator.

The cleaning web 59 that has caused to travel in step S51 can remove the varnish or contamination attached to the stay 51, cleaning plate 56*a*, and guide member 56*b*. Therefore, unlike in the conventional case, the operation of manually removing the varnish or contamination attached to and solidifying on the stay 51, cleaning plate 56*a*, and guide member 56*b* becomes unnecessary, thus reducing the load of the cleaning operation.

After the cleaning liquid 78 is supplied to the upper plate cylinder 21 and blanket cylinder 26 in steps S7 and S15 and the cleaning apparatus 50 cleans the cylinders 21 and 26 in step S23, the printing press is operated at the maximal speed for normal printing operation in step S46 to dry the respective cylinders. Simultaneously to this, the cleaning web 59 is caused to travel in step S51. Since drying of the cylinders and the travel of the cleaning web 59 are performed simultaneously in this manner after cleaning the cylinders, the preparation time until the start of printing as the next operation can be shortened.

Since the cleaning liquid supply devices 75A and 75B supply the cleaning liquid to the two cylinders, i.e., the upper plate cylinder 21 and blanket cylinder 26, separately, the time required for cleaning can be shortened. The cleaning liquid supply devices 75A and 75B may constitute one device where necessary, or the cleaning liquid supply device 75A may serve to blow the cleaning liquid to the circumferential surface of the upper blanket cylinder 25. Since the cleaning apparatus 50 is provided with the cleaning nozzle 57 which serves as the third cleaning liquid supply device, the cleaning ability is improved to shorten the time required for cleaning.

According to this embodiment, the cleaning liquid supply device 75A supplies the cleaning liquid to the upper plate cylinder 21 directly. Alternatively, the cleaning liquid supply device 75A supplies the cleaning liquid to the upper blanket cylinder 25, and indirectly to the upper plate cylinder 21 through the upper blanket cylinder 25. Similarly, according to this embodiment, the cleaning liquid supply device 75B supplies the cleaning liquid to the blanket cylinder 26 directly. Alternatively, the cleaning liquid supply device 75B supplies the cleaning liquid to the lower plate cylinder 28, and indirectly to the blanket cylinder 26 through the lower plate cylinder 28.

Although this embodiment exemplifies cleaning of varnish in the coating device, it can also be applied to cleaning of ink in the printing press. Although the sheet is employed as the object to which the varnish or ink transfers, a web may replace the sheet. The cleaning operation is performed while the lower plate cylinder 28 is kept thrown on the blanket cylinder 26. Depending on the contamination on the lower plate cylinder 28, the lower plate cylinder 28 may be thrown off the blanket cylinder 26, and the three cylinders, i.e., the upper plate cylinder 21, upper blanket cylinder 25, and blanket cylinder 26 may be thrown on each other and cleaned.

As has been described above, according to the present invention, the cylinders that come into contact with each other only during printing/coating are brought into contact with each other during cleaning. Alternatively, the cylinders that do not usually come into contact with each other are brought into contact with each other for cleaning, and are cleaned. Thus, the respective cylinders are not provided with separate cleaning apparatuses, but the plurality of cylinders can be cleaned by one common cleaning apparatus. According to the present invention, the cost can be reduced, and the space to install the cleaning apparatus can be decreased.

Since the cleaning apparatus cleans the cylinders, waste paper due to cleaning by printing is not produced, and accordingly the cost does not increase. Also, the operation of removing the waste paper from the delivery pile becomes unnecessary, thus reducing the load to the operator.

What is claimed is:

1. A cleaning apparatus comprosing:

a first cylinder;

a first liquid supply means for supplying a transfer liquid to said first cylinder;

a second cylinder which performs a transfer to one surface of a transfer target body with the transfer liquid transferred from said first cylinder;

wherein said first cylinder and said second cylinder are usually kept apart from each other;

a cleaning unit which cleans a circumferential surface of said second cylinder in contact therewith;

a third cylinder which is arranged to oppose said second cylinder and performs a transfer to the other surface of the transfer target body;

second liquid supply means for supplying the transfer liquid to said third cylinder;

first cleaning liquid supply means for supplying a cleaning liquid to at least one of said first cylinder and said third cylinder;

control means for controlling said cleaning unit to clean said second cylinder while keeping the second cylinder in direct contact with both of said first cylinder and said third cylinder during a cleaning operation, second cleaning liquid supply means for supplying the cleaning liquid to said third cylinder, wherein said first cleaning liquid supply means supplies the cleaning liquid to said first cylinder, and a fourth cylinder which supplies the transfer liquid received from said second liquid supply means to said third cylinder, wherein said cleaning unit cleans said second cylinder while said first cylinder and said third cylinder are in contact with said second cylinder and said third cylinder is in contact with said fourth cylinder, and wherein said first cylinder comprises a plate cylinder, said second cylinder comprises a blanket cylinder, said third cylinder comprises a blanket cylinder, and said fourth cylinder comprises a plate cylinder.

2. An apparatus according to claim 1, wherein said control means controls supply of the cleaning liquid by said first cleaning liquid supply means, and controls said cleaning unit to come into contact with said second cylinder after rotationally driving said first cylinder and said second cylinder is in contact with said first cylinder and said third cylinder.

3. An apparatus according to claim 1, wherein said third cylinder comprises a transport cylinder which holds and conveys a sheet.

4. An apparatus according to claim 1, wherein said first cylinder comprises a plate cylinder, said second cylinder comprises a blanket cylinder, and said third cylinder comprises a blanket cylinder.

5. A cleaning apparatus comprising:

a first cylinder;

a first liquid supply means for supplying a transfer liquid to said first cylinder;

a second cylinder which performs a transfer to one surface of a transfer target body with the transfer liquid transferred from said first cylinder;

wherein said first cylinder and said second cylinder are usually kept apart from each other;

a cleaning unit which cleans a circumferential surface of said second cylinder in contact therewith;

a third cylinder which is arranged to oppose said second cy der and performs a transfer to the other surface of the transfer target body;

second liquid supply means for supplying the transfer liquid to said third cylinder;

first cleaning liquid supply means for supplying a cleaning liquid to at least one of said first cylinder and said third cylinder;

control means for controlling said cleaning unit to clean said second cylinder while keeping the second cylinder in direct contact with both of said first cylinder and said third cylinder during a cleaning operation, phase detection means for detecting a phase of said transfer device, wherein said control means controls to perform supply of the cleaning liquid from at least one of said first cleaning liquid supply means to said first cylinder and said second cleaning liquid supply means to said third cylinder on the basis of a detection signal of said phase detection means, and a transfer device including said first cylinder, said first liquid supply means and said second cylinder, wherein, said first cylinder has a notch extending in the axial direction in a circumferential surface thereof and when a cleaning liquid supply range of said first cleaning liquid supply means includes the notch of at least one of said first cylinder and said second cylinder, said control means stops said supply of the cleaning liquid to said notch.

6. An apparatus according to claim 5, further comprising second cleaning liquid supply means for supplying the cleaning liquid to said third cylinder, wherein said first cleaning liquid supply means supplies the cleaning liquid to said first cylinder.

7. An apparatus according to claim 5, further comprising a fourth cylinder which supplies the transfer liquid received from said second liquid supply means to said third cylinder, wherein said cleaning unit cleans said second cylinder while said first cylinder and said third cylinder are in contact with said second cylinder and said third cylinder is in contact with said fourth cylinder.

8. A cleaning apparatus comprising:

a first cylinder;

a first liquid supply means for supplying a transfer liquid to said first cylinder;

a second cylinder which performs a transfer to one surface of a transfer target body with the transfer liquid transferred from said first cylinder;

wherein said first cylinder and said second cylinder are usually kept apart from each other;

a cleaning unit which cleans a circumferential surface of said second cylinder in contact therewith;

a third cylinder which is arranged to oppose said second cylinder and performs a transfer to the other surface of the transfer target body;

second liquid supply means for supplying the transfer liquid to said third cylinder;

first cleaning liquid supply means for supplying a cleaning liquid to at least one of said first cylinder and said third cylinder; and control means for controlling said cleaning unit to clean said second cylinder while Keeping the second cylinder in direct contact with both of said first cylinder and said third cylinder during a cleaning operation, wherein said control means controls a press force of said second cylinder against the transfer target body on the basis of a thickness of the transfer target body and controls a position of said second cylinder so that a contact pressure of said second cylinder against said third cylinder during cleaning serves as a cleaning pressure having a cleaning function.

9. An apparatus according to claim 8, further comprising second cleaning liquid supply means for supplying the cleaning liquid to said third cylinder, wherein said first cleaning liquid supply means supplies the cleaning liquid to said first cylinder.

10. An apparatus according to claim 8, further comprising a fourth cylinder which supplies the transfer liquid received from said second liquid supply means to said third cylinder, wherein said cleaning unit cleans said second cylinder while said first cylinder and said third cylinder are in contact with said second cylinder and said third cylinder is in contact with said fourth cylinder.

* * * * *